US005232105A

United States Patent [19]

Gregg

[11] Patent Number: 5,232,105

[45] Date of Patent: Aug. 3, 1993

[54] SOLAR POWERED CRYSTAL DISPLAY RACK

[76] Inventor: Stephen R. Gregg, 2555 W. 69th Ave., Anchorage, Ak. 99518

[21] Appl. No.: 828,156

[22] Filed: Jan. 30, 1992

[51] Int. Cl.[5] ..... A47F 5/00

[52] U.S. Cl. ..... 211/113; 211/1.52

[58] Field of Search ..... 211/1.51, 1.52, 116, 211/115; 248/317, 324; 40/617

[56] References Cited

U.S. PATENT DOCUMENTS

| | | | |
|---|---|---|---|
| 3,031,784 | 5/1962 | Stein | 40/617 X |
| 4,117,630 | 10/1978 | Kalas | 211/1.51 X |
| 4,314,646 | 2/1982 | Purnell | 211/113 |
| 4,729,182 | 3/1988 | Sherman | 40/617 X |
| 4,756,109 | 7/1988 | Marcus | 40/617 X |

*Primary Examiner*—Robert W. Gibson, Jr.
*Attorney, Agent, or Firm*—Michael J. Tavella

[57] ABSTRACT

A solar powered crystal display is disclosed. The device is used to display various crystal forms in a window. A series of friction drive wheels and a solar powered electric motor are used to rotate the crystals, which are suspended under a plate. The plate is formed into any design desired. For example the plate can be shaped like a cloud, the sun, a star, animals, rainbows, etc. The purpose of the plate is to conceal the drive mechanism from view. The plate is hung from a flange attached to the drive mechanism. The device can also be operated without the plate. An auxiliary drive unit is also disclosed that permits additional crystals to be suspended from the original device. The device can be placed against a window using suction cups or can be suspended from hooks placed into the window casing. As the crystals are rotated, the sunlight will refract through the crystals, producing aesthetical pleasing, colorful patterns in a room.

13 Claims, 6 Drawing Sheets

SOLAR POWERED CRYSTAL DISPLAY RACK

This invention relates to crystal display racks and more particularly to solar powered crystal display racks.

BACKGROUND OF THE INVENTION

Many people display cut crystals in window displays. These cut crystals act like prisms to refract and diffuse light. Placing these crystals in a window permits sunlight to pass through the crystal, which produces beams of color in aesthetical pleasing patterns. The crystals are typically suspended by a string from a hook that is secured to the window by a suction cup. Other types of hooks and suspension means can be used as well.

Usually, the crystal remains motionless while it is suspended against the window. Thus, the light patterns will change only over time, as the patterns of sunlight change. It is desired to produce a more dynamic display with the crystals by causing the crystals to rotate, instead of keeping them motionless.

To achieve this effect, and to allow display of multiple crystals, the present invention consists of a large, formed plate of opaque material. This plate can be formed into any desired shape of form, such as a cloud, the sun, an animal, etc. The plate is colored to achieve whatever effect is desired. A drive support assembly is attached to the rear of the plate (the side that faces the window). This drive support assembly supports the friction drive wheel mechanisms, the drive motor, and a solar cell to power the motor. A series of friction drive wheels are installed on the drive support assembly to turn the crystals that are suspended from shafts that extend downwardly from the drive wheels. The shafts are fitted with clips that are used to secure the strings that support the crystals.

A drive motor is also secured to the drive support assembly. The drive shaft of the motor is connected to the drive mechanism by a small crown gear. The motor is powered by a solar cell that is secured to the rear of the drive support assembly.

In use, the viewer will see the plate and the crystals suspended below the plate. As the sun energizes the solar cell, the motor will cause the gear mechanisms to rotate the strings, thereby rotating the crystals.

Alternatively, the plate can be left off and the drive mechanism can be placed high on the window. The solar cell can be placed lower on the window to assure adequate light to drive the device. There are many variations for placement of the device, and use of the opaque plates.

DETAILED DESCRIPTION OF THE INVENTION

Figure 1:
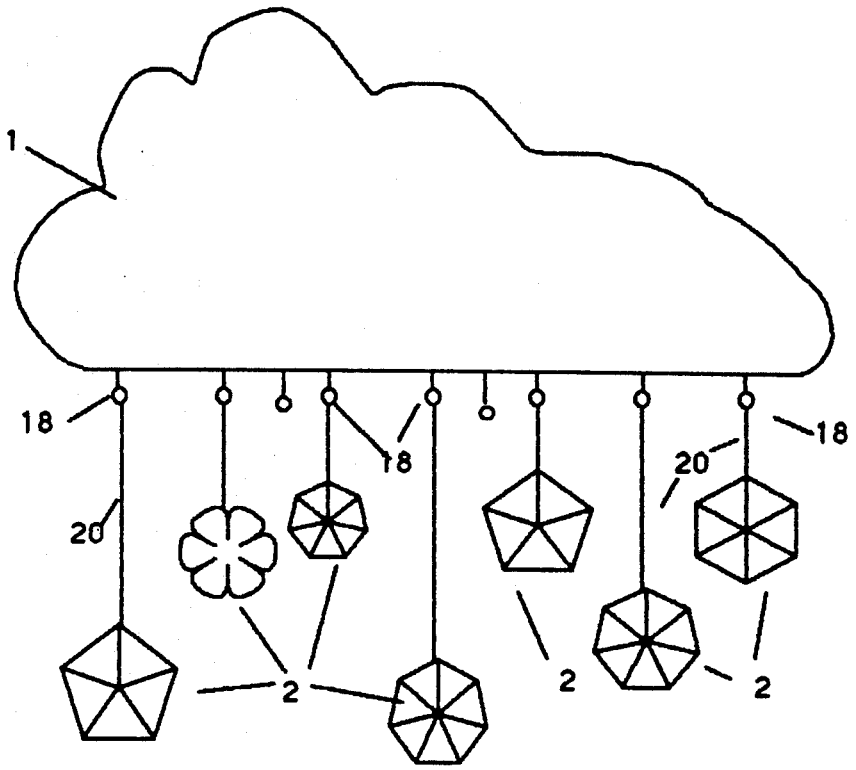
FIG. 1 is a front view of the invention.
Figure 2:
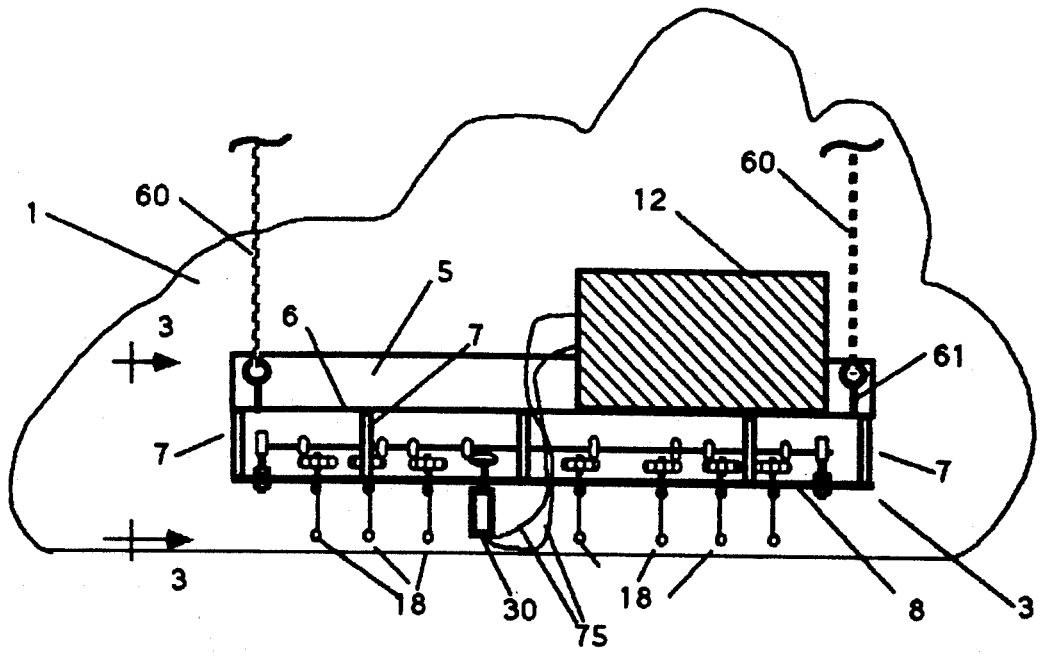
FIG. 2 is a back view of the invention showing the drive support assembly and the solar cell.
Figure 3:
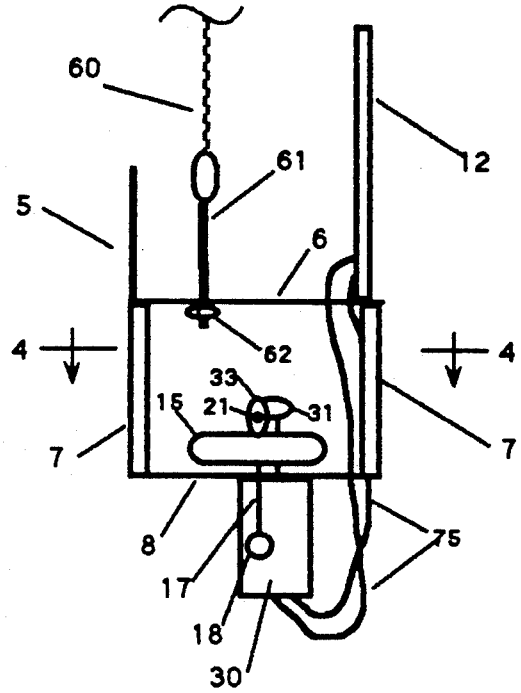
FIG. 3 is a side view of the drive support assembly taken along the lines 3—3.

Referring now to the drawings and particularly FIGS. 1, 2 and 3, the invention consists of two main assemblies. The first is a flat, thin, formed plastic plate 1. The plate 1 is formed into any desired shape, which forms a design. For example, in FIG. 1, the plate 1 is in the shape of a cloud. The plate 1 can be any shape desired. The shape of plate 1, when used to conceal the drive mechanism, will dictate the number of crystals that can be suspended from the device. For example, FIG. 1 shows 7 crystals 2.

Plate 1 can be colored in any color desired and can have designs painted on the face of the plate, or attached to the plate with decals, etc.

Referring now to FIG. 2, the back of plate 1 is shown. The second main assembly, which is the more important of the two, is a drive support assembly 3. The drive support assembly 3 consists of a frame that has an upper flange 5 that is connected to the upper dust cover 6. A drive support plate 8, which can also be called a rack, is suspended parallel to, and below the upper dust cover 6. The upper dust cover 6 is connected to the drive support plate 8 by means of a series of posts 7. Use of posts creates an open area that is protected by the upper dust cover 6, but provides access to the drive mechanism.

The drive support assembly 3 is sized to hold a number of friction drive wheel assemblies 10. The bracket also holds the solar cell 12 and support hooks 13 as shown in FIGS. 2 and 3.

Figure 5:
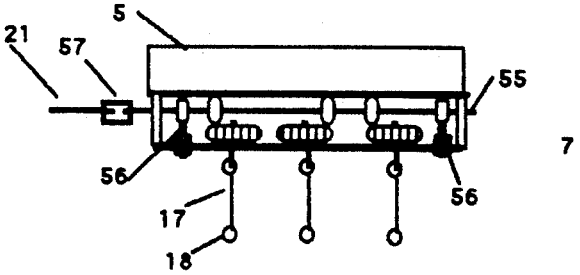
FIG. 5 is a side view of the auxiliary drive assembly shown removed from the main drive support assembly as taken along the lines 5—5.
Figure 4:
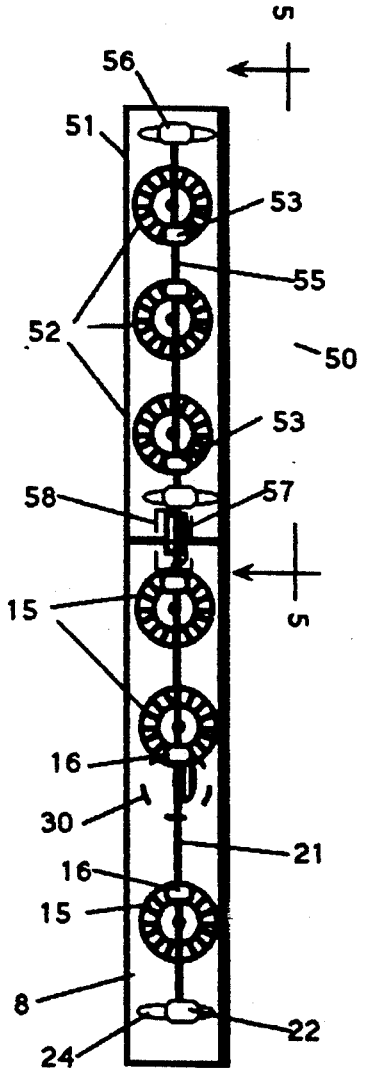
FIG. 4 is a top view of the drive support assembly with the auxiliary drive assembly.
Figure 9:
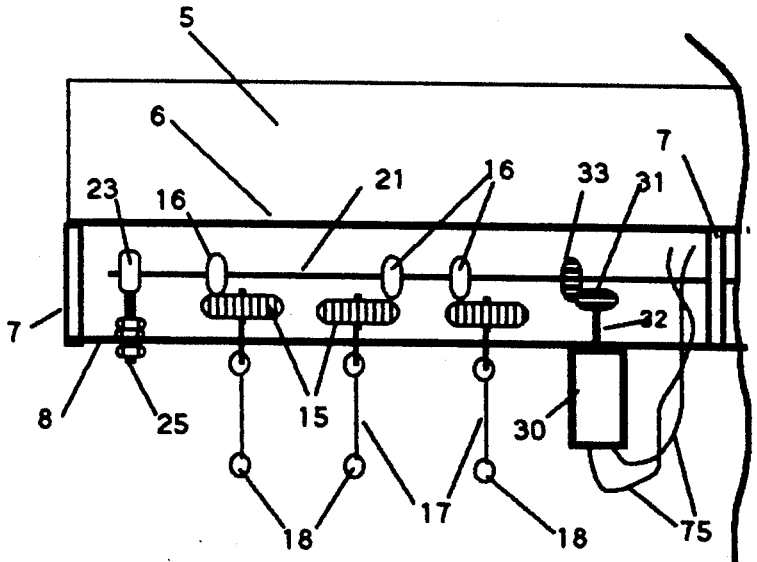
FIG. 9 is a detail showing the motor drive gears and the drive assembly.

Referring now to FIGS. 4, 5 and 9, each drive wheel assembly 10 consists of a large friction drive wheel 15 that is a flat open cylinder, and a small friction drive wheel 16. A drive shaft 17 passes through a hole in the drive support plate 8 for each wheel used. The drive shaft 17 is used to turn the crystals, as discussed below. Bearings (not shown) support the drive shaft 17 to allow the large friction drive wheels 15 to turn freely. The drive shaft 17 has sufficient length to secure a quick release clip 18 that is used to secure the crystal to the drive shaft 17. The crystals 2 are attached to the quick release clips 18 by small length of invisible thread 20, or monofilament line.

Figure 6:
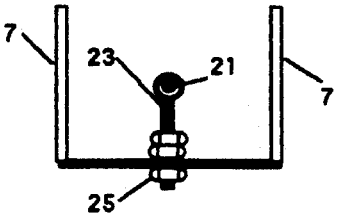
FIG. 6 is a detail view of the jack shaft bearing assembly.
Figure 7:
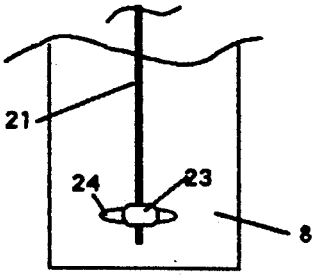
FIG. 7 is a top view detail of the jack shaft bearing.

The drive wheels 15 are driven by small friction drive wheels 16. One small friction drive wheel 16 is provided for each large friction drive wheel 15. The small friction drive wheels 16 are positioned on a jack shaft 21 that lies above the large friction drive wheels 15, and is parallel to the plate 1. The jack shaft 21 is supported by a bearings 22 located at both ends of the drive support plate 8, as shown in FIG. 4. The preferred bearings 22 are constructed from small eye bolts 23 (see FIGS. 6 and 7). The eye bolts 23 are placed through slots 24 that are formed in the drive support plate 8. A number of hex nuts 25 are used to maintain vertical spacing of the eye bolt 23. The slot 24 is used to ensure proper horizontal placement of the jack shaft 21. The small friction drive wheels 16 rest on the large friction drive wheel's cylindrical rim and must be positioned exactly in the center of the lateral plane of the drive wheels to prevent the small friction drive wheels from trying to push themselves off the drive wheels.

The position of the small friction drive wheels 16 will dictate the direction of rotation of the large friction drive wheels 15, and ultimately, the crystals 2. Placing the small friction drive wheels 16 at opposites ends of adjacent large friction drive wheels 15 will cause adjacent crystals 2 to rotate in opposite directions. See, e.g. FIG. 8.

Although friction drive wheels are preferred, gears can readily be substituted for the wheels. as can any other mechanical drive system that will operate in a similar manner to the construction discussed above. In fact, the drawing figures need not be changed to view the placement of gears in place of the friction drive wheels.

The drive mechanism is powered by a small electric motor 30, which is secured to the drive support plate 8 by means common to the art. The motor 30 is placed below the drive support plate 8 in the preferred embodiment to keep the motor 30 from interfering with the large friction drive wheels 15 and to permit a more compact design. A pinion gear 31 is attached to the motor shaft 32 (see FIG. 9), and is aligned with a crown gear 33, which is attached to the jack shaft 21. The motor 30 turns the pinion gear 31, which in turn engages the crown gear 33, which causes the jack shaft 21 to turn, which rotates the large friction drive wheels 15 and the crystals 2.

Figure 15:
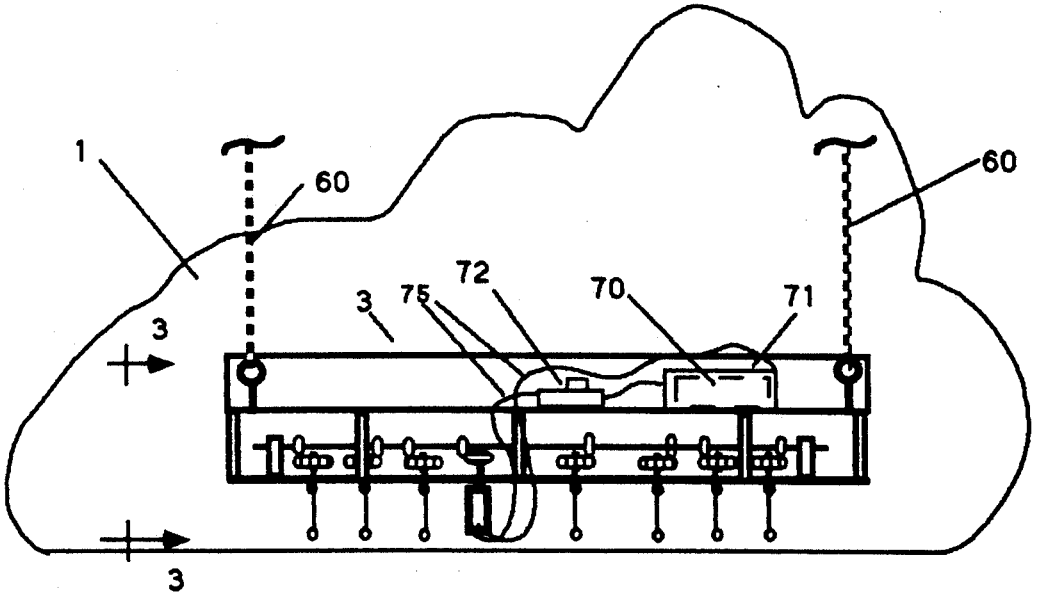
FIG. 15 is a rear view of the device showing the use of a battery circuit.

The motor 30 is powered by a solar cell 12, which is secured to the back of the panel 1 as shown. A pair of wires 75 connect the motor to the solar cell. The size of the solar cell will dictate the amount of power available and hence, the number of crystals that can be used. Although use of a solar cell is preferred, the device can be used with a battery 70 as shown in FIG. 15. The battery 70 would be placed in a battery holder 71 as shown. A switch 72 is required, however, to shut down operation of the device when it is not desired. FIG. **11*b* shows the circuit for the battery operation. Although not shown, specifically, a switch can also be incorporated in the circuit with a solar cell. By substituting the solar cell for the battery in FIG. 11*b***, the circuit for the switched solar cell would be shown. Adding a switch to the circuit is well within the knowledge of a person of ordinary skill in the art.

The speed of the motor will create either beneficial or non-desired effects. If the crystals turn too quickly, the spectral emissions will have an excessive amount of flicker effects, which could prove annoying. The preferred speed for the crystal rotation is approximately 7 rpm. Thus, the motor 30 should be geared to produce that desired speed.

Figure 8:
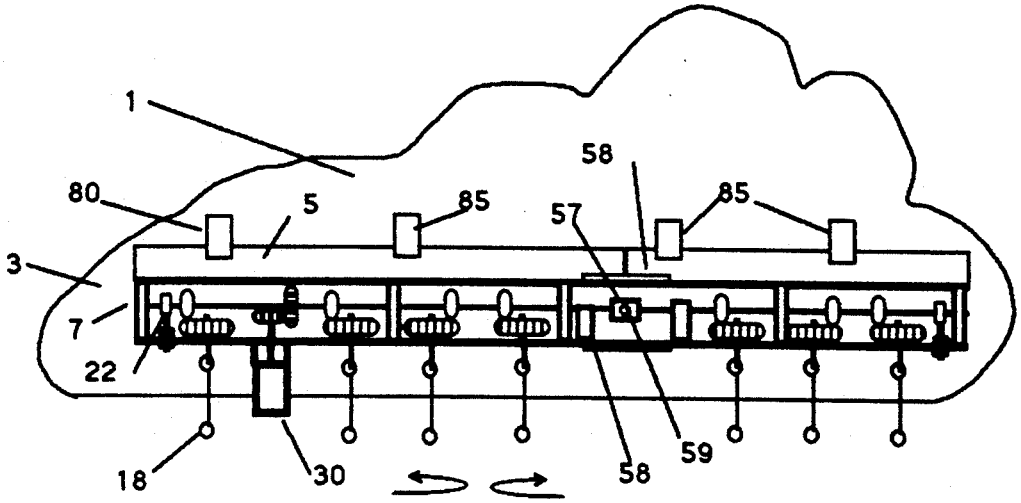
FIG. 8 is a back view of the invention showing the drive support assembly with the auxiliary drive unit attached, the plate supports and the rotational aspects of the drive shafts.

Referring now to FIGS. 4 and 5, in the preferred embodiment, an auxiliary drive unit 50 is also provided. The auxiliary drive unit 50 is of similar construction to the primary drive unit, except that it is smaller. The auxiliary drive unit 50 has an drive support assembly 51 upon which a number of large friction drive wheels 52 are positioned. These assemblies are identical to those discussed above for the primary drive assembly. As in the case of the primary drive assembly, the auxiliary drive unit 50 is powered by a jack shaft 55. The jack shaft 55 is supported by bearings 56 as shown. The jack shaft 55 may be joined to the primary jack shaft 21 by a coupler 57 (see also FIG. 8). The coupler is secured to the jack shafts by a set screw 59, or other means common to the art. The auxiliary drive unit 50 is fastened to the primary drive assembly with a junction plate 58 as shown in FIG. 8. Alternatively, plastic clips or other means common to the art can be used to join the two drive plates together.

Plate 1 is fastened to the auxiliary drive unit 50 using the same means as provided for the primary drive unit. These means will be discussed below.

Although the drawings show a primary drive unit and an auxiliary drive unit, the device can be operated with only a primary drive unit. The auxiliary drive unit can be omitted and not used at all. Further, as discussed below, the number of drive wheels is limited by the size of the plate 1, when the plate 1 is used to hide the operating mechanism. Although a given number of wheels is shown in the drawing, this is done only for illustrative purposes. The number of wheels can be changed as desired and the drawings are not meant to limit the design to the number shown.

Figure 14:
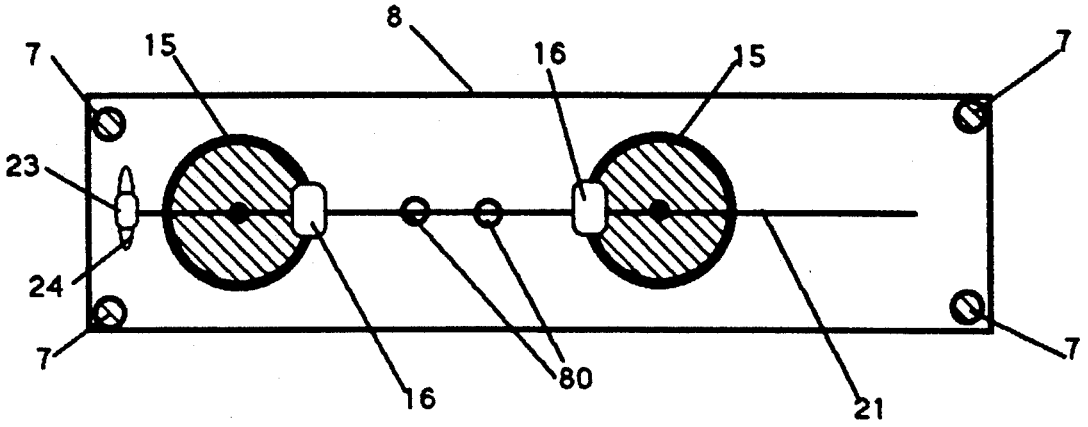
FIG. 14 is a top detail view of the drive wheels showing the auxiliary holes for mounting fixed crystals.
Figure 16:
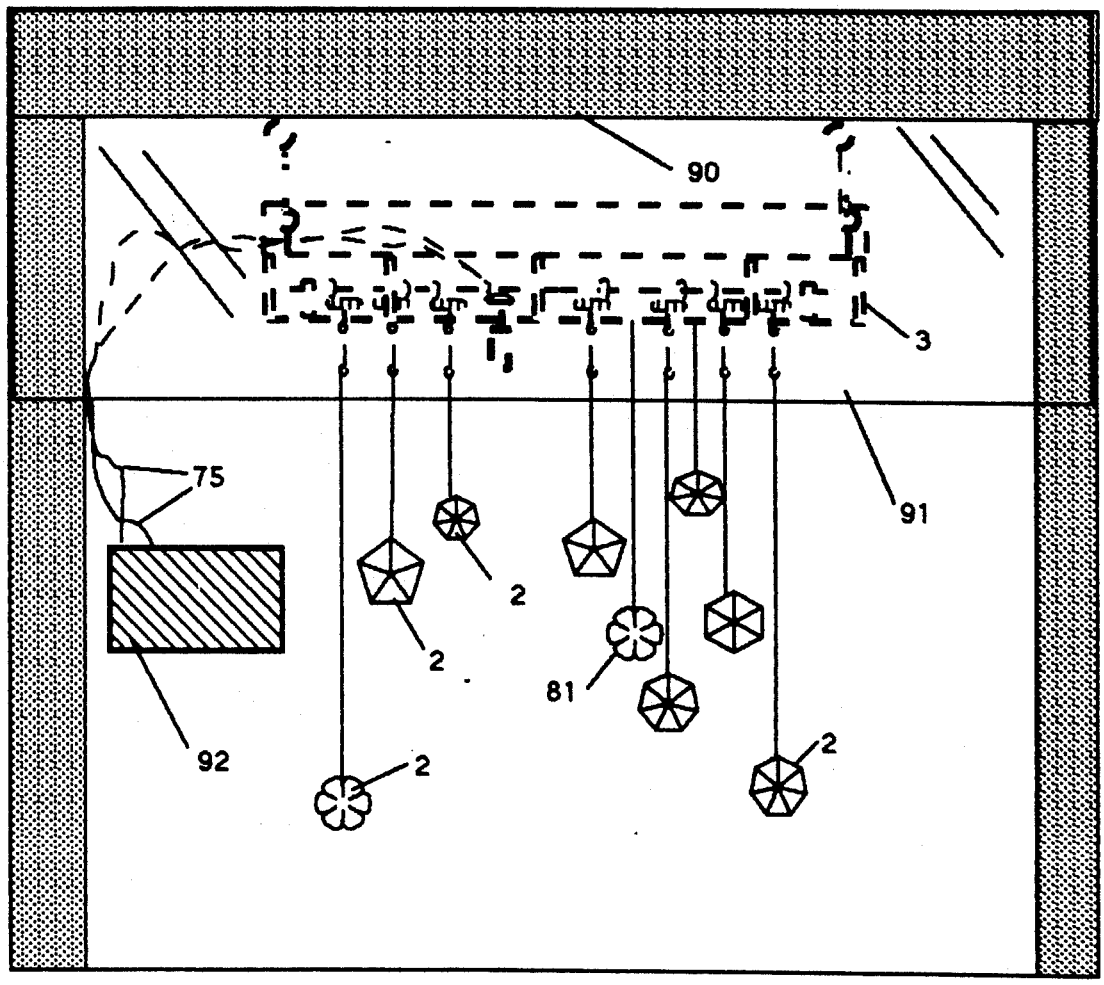
FIG. 16 is a front view of a window having a valance showing how the device can be mounted high on the window without using a face plate.

Referring to FIGS. 14 and 16, additional holes 80 can be formed in the drive support plate 8 to accommodate a number of stationary crystals, if desired. These additional crystals 81 are suspended from the device but do not turn.

Referring now to FIGS. 2, 3, 12 and 13, the invention is typically suspended from a window using suction cups. A pair of chains 60 is attached to the upper dust cover 6 as shown in FIG. 3. It is also possible to use invisible thread or monofilament line, if desired. The chain 60 is connected to the dust cover 6 by means of an eye bolt 61 and a nut 62. The chain can be attached using any other similar means, however. For example where the dust cover 6 is formed of plastic, the eye bolts can be formed into the dust cover 6 when it is formed.

Figure 12:
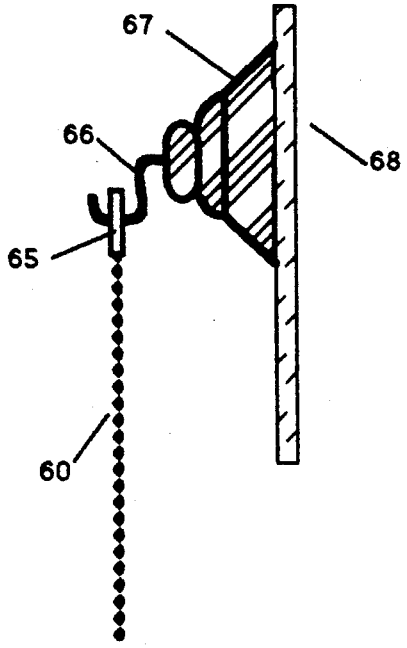
FIG. 12 is a detail of the support mechanism utilizing suction cups and chains.

The chain 60 has an eye 65 attached to the free end which is used to secure the chain over a pair of hooks 66. The hook 66 can be attached to a suction cup 67, as shown in FIG. 12. The suction cup 67 can then be applied to the window 68 as shown.

Figure 13:
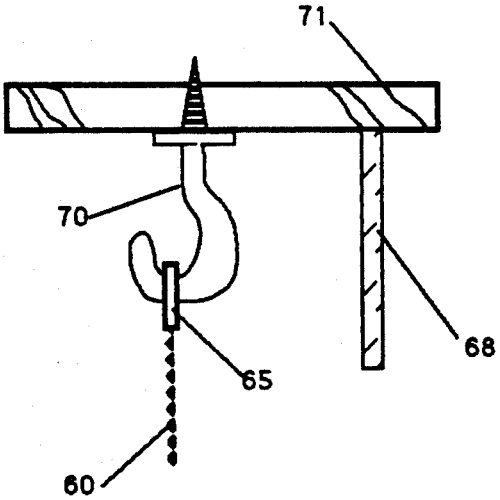
FIG. 13 is a detail of the support mechanism utilizing a hook attached to the window frame.

Alternatively, the hooks 66 can be used to support the device from the window casing. FIG. 13 shows one type of arrangement. A hook 70 is screwed into the window casing 71 as shown. The eye 65 can then be hooked over the hook 70 to support the device in front of a window.

Figure 10:
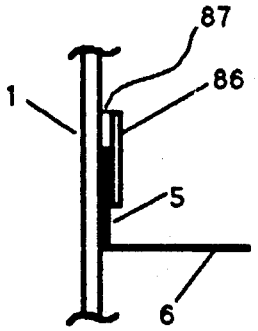
FIG. 10 is a detail of the plate attachment means.

Referring now to FIGS. 8 and 10. The plate 1 is attached to the drive support assembly 3 by means of a series of flat hangers 85, which are molded or formed into the plastic plate 1. Referring to FIG. 8, the flat hangers 85 have a back plate 86 and a spacer 87. The combination of the spacer and back plate forms a lip that can be placed over the upper flange 5. The plate 1 simply hangs on the drive assembly. The number of flat hangers 85 are set by the size of the plate 1. Of course, it the plate 1 is formed of materials other than plastic, the flat hangers 85 can be modified and attached to whatever material is used accordingly.

OPERATION

Figure 11A:
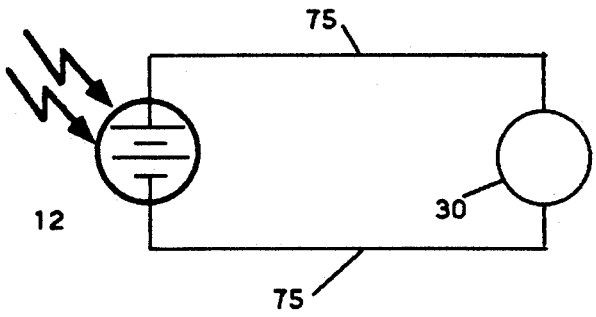
FIG. 11*a* is a circuit diagram of the solar cell-motor circuit.
Figure 11B:
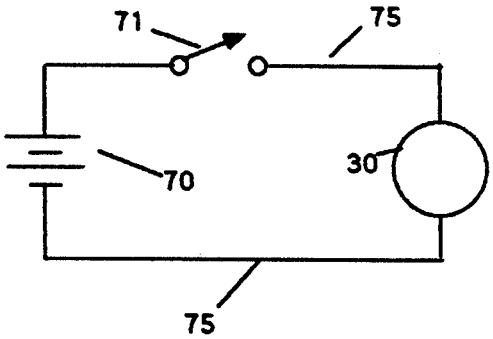
FIG. 11*b* is a circuit diagram or the battery-motor circuit.

Referring now to FIG. 11*a*, a schematic diagram of the solar powered electrical circuit is shown. Once the device is placed against a window, and sunlight passes through the window, the solar cell will become active and begin to power the motor, which will in turn, drive the individual crystals. Operation of the device with a battery is discussed above. The circuit is shown in FIG. 11*b*.

Referring to FIG. 16, an alternative operating mode can also be employed. Here, the plate 1 is not used. Rather, the drive mechanism 3 is suspended near the top of a window 90, where it is out of plain view (perhaps covered by blinds or a valence 91). The crystals are suspended as before, but the effect will be different because only the crystals will be visible. The solar cell 92 is designed to be removable from the drive mechanism (a pair of clips (not shown) can be attached to the upper dust cover 6 to hold the solar cell in place when the remote operation is not desired, and can be placed lower on the window, if necessary, to provide adequate power for the device.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A solar powered display rack for crystals comprising:

a) a plurality of crystal forms;

b) mechanical rotation means for rotating said crystal forms;

c) connection means for connecting said crystal forms to said mechanical rotation means;

d) an electric motor, mechanically connected to said mechanical rotation means, to drive said mechanical rotation means;

e) a solar cell, fixedly attached to said mechanical rotation means to power said electric motor;

f) wiring means to electrically connect said solar cell to said electric motor; and g) support means to hold said plate in proximity to a window.

2. The solar powered display for crystals of claim 1 further comprising a plate formed into an aesthetic design and having a top, a bottom, a front and a back; and means for removably attaching said mechanical rotation means to the back of said plate.

3. The solar powered display for crystals of claim 1 wherein said mechanical rotation means for rotating said crystal forms comprises:

a) a plurality of drive assemblies, each drive assembly having a large friction drive wheel in contact with a small friction drive wheel, said large friction drive wheels each having a vertical shaft that connects to said connection means for connecting said crystal forms to said mechanical rotation means;

b) a jack shaft, displaced above said large friction drive wheels and in communication with said small friction drive wheels such that when said jack shaft is turned, said small friction drive wheels engage and turn said large friction drive wheels, thereby rotating said crystals.

4. The solar powered display rack for crystals of claim 1 further comprising an auxiliary drive unit having additional mechanical rotation means for rotating said crystal forms and additional connection means; said auxiliary drive unit having an auxiliary jack shaft and connecting means for removably connecting said jack shaft to said auxiliary jack shaft.

5. The solar powered display rack for crystals of claim 1 further comprising an on-off switch electrically connected between said solar cell and said motor to control the operation of said motor.

6. The solar powered display rack for crystals of claim 1 wherein said mechanical rotation means has a plurality of holes placed therein for the placement of fixed crystals that are suspended from said device, but do not rotate.

7. The solar powered display rack for crystals of claim 1 wherein said solar cell is removably attached to said mechanical rotation means whereby the solar cell can be moved to a location remote from said device for optimal solar exposure.

8. A powered display for crystals comprising:

a) a plurality of crystals forms:

b) mechanical rotation means for rotating said crystal forms;

c) connection means for connecting said crystal forms to said mechanical rotation means;

d) an electric motor, mechanically connected to said first mechanical rotation means, to drive said mechanical rotation means and said auxiliary drive unit;

e) an electrical power source, removably attached to to power said electric motor;

f) wiring means to electrically connect said electrical power source to said electric motor; and g) support means to hold said mechanical rotation means in proximity to a window.

9. The powered display for crystals of claim 8 wherein the electrical power source comprises a battery and a switch, electrically connected such that said switch controls the flow of electrical energy to the motor.

10. The powered display for crystals of claim 8 further comprising a plate formed into an aesthetic design and having a top, a bottom, a front and a back; and means for removably attaching said mechanical rotation means to the back of said plate.

11. The powered display for crystals of claim 8 further comprising a second, auxiliary drive unit having additional mechanical rotation means for rotating said crystal forms and additional connection means; said auxiliary drive unit also being in communication with said first mechanical rotation means whereby when said first mechanical rotation means said auxiliary drive unit is operated synchronously with said first mechanical rotation means.

12. The powered display for crystals of claim 8 wherein said mechanical rotation means for rotating said crystal forms comprises:

a) a plurality of drive assemblies, each drive assembly having a bevel gear in contact with a spur gear, said bevel gears each having a vertical shaft that connects to said connection means for connecting said crystal forms to said mechanical rotation means;

b) a drive shaft, displaced above said bevel gears and in communication with said spur gears such that when said drive shaft is turned, said spur gears engage and turn said bevel gears, thereby transferring said rotation to said rotation means for connecting said crystal forms to said mechanical rotation means.

13. The powered display for crystals of claim 8 wherein said mechanical rotation means has a plurality of holes placed therein for the placement of fixed crystals that are suspended from said device, but do not rotate.

* * * * *